US005111601A

United States Patent [19]

Casagrande

[11] Patent Number: 5,111,601

[45] Date of Patent: May 12, 1992

[54] EXCAVATION DEVICE WITH ROTARY CUTTER HAVING A HORIZONTAL AXIS

[75] Inventor: Bruno Casagrande, Fontanafredda, Italy

[73] Assignee: Casagrande SpA, Fontanafredda, Italy

[21] Appl. No.: 662,958

[22] Filed: Mar. 1, 1991

[30] Foreign Application Priority Data

Mar. 16, 1990 [IT] Italy ..... 83350 A/90

[51] Int. Cl.[5] ..... E02F 3/24

[52] U.S. Cl. ..... 37/91; 37/80 A; 37/189; 37/191 R; 299/82

[58] Field of Search ..... 37/80 A, 91, 94, 189, 37/191 R, 191 A, DIG. 16; 299/82

[56] References Cited

U.S. PATENT DOCUMENTS

| | | | |
|---|---|---|---|
| 107,529 | 9/1870 | Osgood | 37/94 |
| 1,210,412 | 1/1917 | Budlong | 37/80 A |
| 1,455,206 | 5/1923 | Howe et al. | 37/80 A |
| 1,519,897 | 12/1924 | Asplund | 37/189 X |
| 2,002,239 | 5/1935 | Davis | 37/DIG. 16 X |
| 2,751,207 | 6/1956 | Barrett | 37/189 |
| 3,157,438 | 11/1964 | Lundquist | 299/82 |
| 3,318,638 | 5/1967 | Kilbourne | 37/189 X |

FOREIGN PATENT DOCUMENTS

| | | | |
|---|---|---|---|
| 211424 | 9/1986 | Japan | 37/91 |

*Primary Examiner*—Randolph A. Reese
*Assistant Examiner*—Arlen L. Olsen
*Attorney, Agent, or Firm*—Nixon & Vanderhye

[57] ABSTRACT

Excavation device (10) with rotary cutter having a horizontal axis, the device (10) having a support structure (11) for excavation means consisting advantageously of pairs of cutter wheels (12-112) able to rotate about their axis (13), the rotation being induced by drive means (15) and suitable transmission means, the cutter wheels (12-112) being equipped with main excavation tools (18), an excavation chain (22) bearing secondary excavation tools (23) being associated with each cutter wheel (12-112) and being actuated by a sprocket wheel (19) firmly secured (20) to the respective cutter wheel (12-112) and cooperating with a transmission means (21) secured to the support structure (11), the secondary excavation tools (23) borne by the excavation chains (22) of each pair of cutter wheels (12-112) covering almost the whole excavation face between the main excavation tools (18).

4 Claims, 1 Drawing Sheet

EXCAVATION DEVICE WITH ROTARY CUTTER HAVING A HORIZONTAL AXIS

BACKGROUND OF THE INVENTION

1. Field of the Invention

This invention concerns an excavation device with a rotary cutter having a horizontal axis. To be more exact, the invention concerns an excavation device with a rotary cutter having a horizontal axis, the device comprising additional excavation means suitable to provide an excavation face without any unexcavated spaces.

The device of the invention can work on any kind of ground and is suitable to excavate partitions, pits, trenches, ditches, etc.

2. Discussion of Prior Art

The state of the art covers a plurality of excavation apparatuses comprising rotary excavation tools of which the axis of rotation can be vertical or horizontal.

Among the excavation tools with a horizontal axis the most widely used are cutters, to which we shall refer in the description that follows.

These cutters normally consist of two pairs of wheels having their axes parallel to each other and also parallel to the surface being excavated.

In the most modern types each pair of cutter wheels is generally driven by at least one hydraulic motor which sets the wheels in rotation through suitable transmission means.

The excavation tools of the state of the art, whilst they ensure an excellent performance with regard to their excavation capability, entail great drawbacks concerning the obtaining of a continuous excavation face without any unexcavated spaces. In other words the tools of the state of the art do not ensure efficient excavation conditions in the portions of ground between the cutter wheels belonging to the same pair of cutter wheels nor in the zones between one pair of cutter wheels and the other pair.

The space between the cutter wheels belonging to the same pair of cutter wheels is determined by the dimensional requirements of the bearing structure and by the dimensions of the means supplying energy or transmission of motion.

The space between two neighbouring pairs of cutter wheels is determined by problems linked to the danger of contact between the peripheral tools of one pair of cutter wheels and the other pair.

The state of the art includes some solutions disclosed to overcome the above problems, but the results thereof are unsatisfactory from the points of view of working efficiency and constructional complexity.

SUMMARY OF THE INVENTION

The present applicant has therefore designed, tested and embodied an excavation device able to overcome all the problems of the state of the art.

The device according to the invention has a structure comprising rotary cutters with a horizontal axis of a substantially known type, which includes two pairs of cutter wheels suitably driven by their own motors through relative trasmissions.

According to the invention each cutter wheel of each pair of cutter wheels is coaxially associated with an element to actuate an excavation chain, this element being itself actuated by its corresponding cutter wheel.

This actuation element is positioned in the zone facing the space between opposed wheels of the same pair of wheels.

In this way the excavation tools borne on the chains can work suitably in the space between the wheels of each pair so as to cover the whole excavation face and not to leave unexcavated spaces.

These actuation elements of the excavation chains are associated with coordinated transmission elements positioned and supported on the bearing structure of the excavation device.

According to a variant the two excavation chains are replaced by one single excavation chain driven by synchronized actuation elements.

The radial extent of the tools borne on the excavation chains is advantageously less, in relation to the excavation face, than the radial extent of the tools of the cutter wheels. This enables excavations to be carried out under correct conditions of dynamic stress on the device and also makes it possible to effect works involving perfectly defined and reliable reciprocal connections between the usual excavations arranged in succession.

These and other special features of the invention will be made clearer in the description that follows.

BRIEF DESCRIPTION OF THE DRAWINGS

The attached figures, which are given as a non-restrictive example, show the following.

DETAILED DISCUSSION OF PREFERRED EMBODIMENTS

Figure 2:
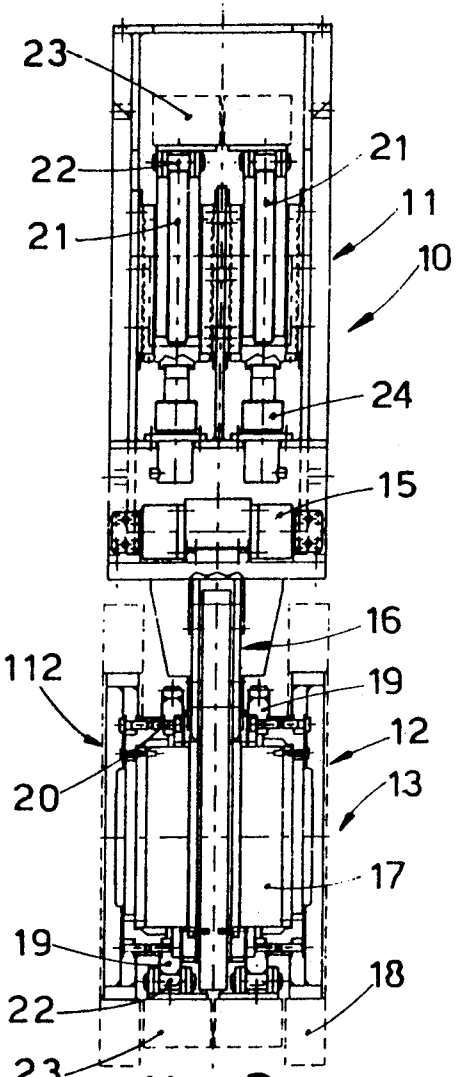
FIG. 2 is a front view of the device of FIG. 1.

The figures show an excavation device 10 according to the invention. This device 10 comprises a support structure 11 for excavation means, which in this example are two pairs of cutter wheels, each pair consisting of a righthand cutter wheel 12 and lefthand cutter wheel 112.

The cutter wheels 12–112 rotate about their own axis 13; the rotation of one pair of wheels is advantageously in the opposite direction to that of the other pair of wheels so as to balance the stresses during excavation work and to bring the excavated material to a central zone whence it is suitably removed by suitable aspiration means 14.

The actuation of each pair of cutter wheels 12–112 is provided by their own actuation means, which is advantageously a hydraulic motor 15 secured to the support structure 11.

The motion is fed to the cutter wheels 12–112 by an appropriate transmission, which may consist of chains, gearwheels or any other means suitable for the purpose and positioned on uprights 16 and in casings 17.

The cutter wheels 12–112 are associated with main excavation tools 18 shown with lines of dashes in the figures.

All the above is a part of the state of the art.

The excavation device 10 according to the invention provides for each cutter wheel 12–112 of each cutter pair to be associated coaxially with a sprocket wheel or pinion 19.

The sprocket wheel 19 is solidly fixed, for instance by means of bolts 20, to the structure of the relative cutter wheel 12 or 112 and is set in rotation thereby.

A coordinated transmission wheel 21 located on the support structure 11 cooperates with each sprocket wheel 19 to drive in conjunction an excavation chain 22.

Figure 1:
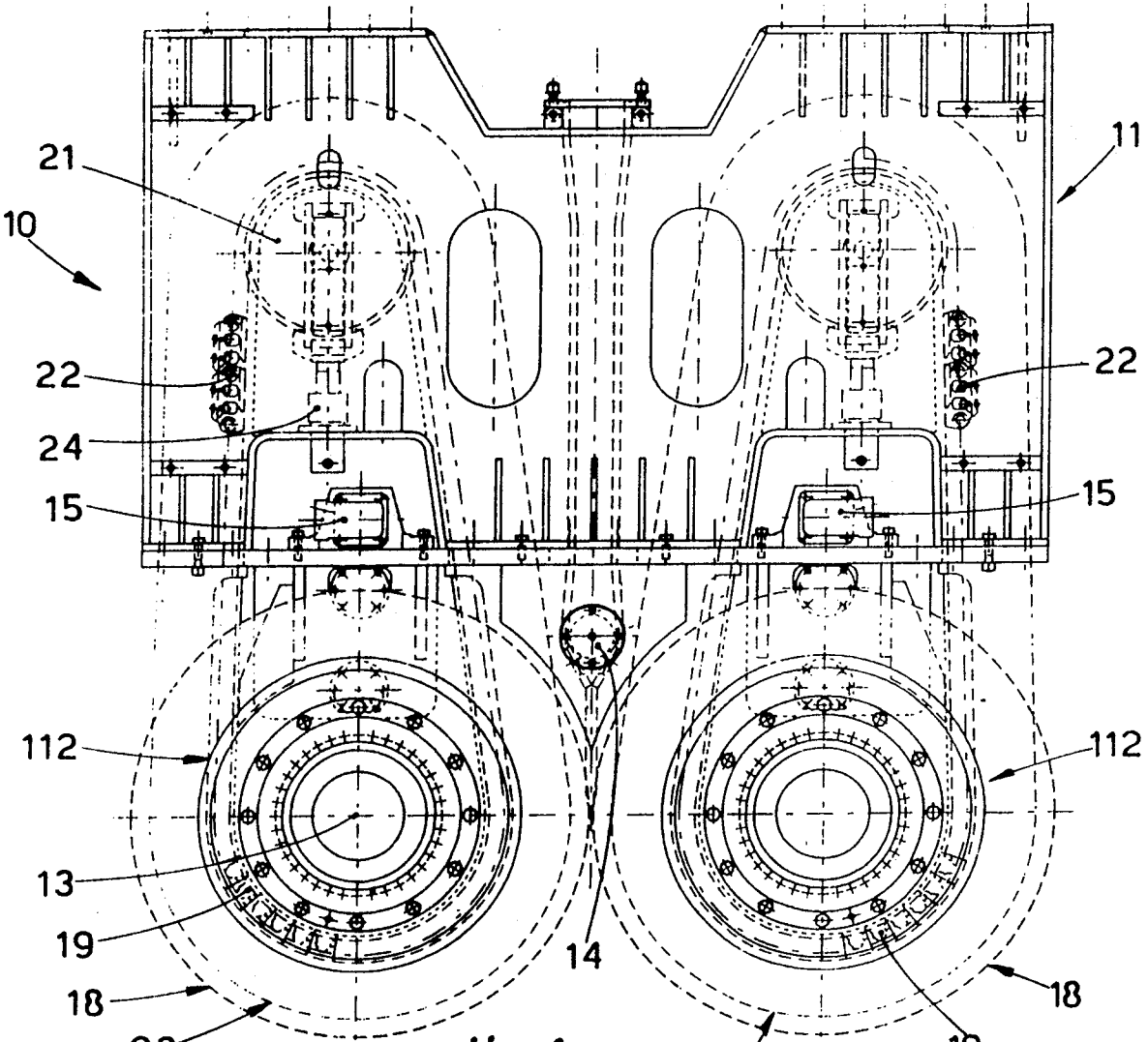
FIG. 1 is a side view of a preferred embodiment of the device according to the invention.

Each excavation chain 22 bears on its periphery suitable secondary excavation tools 23, shown in the diagrams of FIGS. 1 and 2 with lines of dashes.

The sprocket wheels 19 are positioned in the space between the opposed surfaces of the righthand 12 and lefthand 112 cutter wheels belonging to the same pair of cutter wheels. Their positioning enables the whole of the excavation face between the cutter wheels 12 and 112 to be fully covered by means of the secondary excavation tools 23.

The radial extent of the secondary tools 23 is less than that of the main tools 18 for the reason cited above.

FIGS. 1 and 2 show a tensioner assembly 24 which maintains the required working tension of the excavation chain 22.

We have described here a preferred embodiment of the invention, but it is obvious that many variants are possible for a person skilled in this field without departing thereby from the scope of the invention as claimed.

I claim:

1. Excavation device (10) with rotary cutter having a horizontal axis, said device (10) comprising:

a support structure (11);

excavation means including pairs of cutter wheels (12-112) mounted for rotation about their axis (13), said excavation means including drive means (15) and suitable transmission means for rotating said cutter wheels, said cutter wheels (12-112) being equipped with spaced apart main excavation tools (18), said device (10) further including:

a plurality of excavation chains (22), each chain including secondary excavation tools (23) and associated with each respective cutter wheel (12-112), a sprocket wheel (19) firmly secured (20) to the respective cutter wheel (12-112) for actuating each respective chain and a transmission means (21) secured to the support structure (11) for mounting each said chain, said secondary excavation tools (23) borne by the excavation chains (22) of each pair of cutter wheels (12-112) covering a majority of the space between the main excavation tools (18).

2. Device (10) as claimed in claim 1, wherein said sprocket wheel (19) and said main excavation tool (18) have radii and said sprocket wheel radius is less than the radius of the main excavation tools (18).

3. Device (10) as claimed in claim 1 further including assemblies (24) for tensioning the excavation chains (22).

4. An excavation device comprising:

a support structure;

first and second pairs of cutter wheels;

means for spaced apart mounting of said cutter wheels of each pair for rotation about a common axis on said support structure, said mounting means includes means for mounting each of said pairs such that wheels in respective pairs are in a common plane;

drive means for rotating said cutter wheels;

at least two sprocket wheels, at least one secured to rotate with a respective one of said first and second pairs of cutter wheels, each of said at least one sprocket wheels located between the cutter wheels of a respective pair;

at least two chains, each equipped with secondary excavation tools and each associated with a respective one of said at least two sprockets;

at least two support and tensioning sprockets, each associated with a respective one of said at least two chains, for supporting said chains for rotation in conjunction with rotation of respective sprockets and pairs of cutter wheels, each of said cutter wheels including main excavation tools and said secondary excavation tools of said at least one chain located within the space between said main excavation tools of respective cutter wheel pairs.

* * * * *